US006062153A

United States Patent [19]

Nanthavong

[11] Patent Number: 6,062,153

[45] Date of Patent: May 16, 2000

[54] SEWING MACHINE HAVING A MECHANICAL METERING DEVICE

[75] Inventor: Phounsavath Nanthavong, Elgin, Ill.

[73] Assignee: Union Special Corporation, Huntley, Ill.

[21] Appl. No.: 09/295,646

[22] Filed: Apr. 20, 1999

[51] Int. Cl.[7] ..... D05B 27/10; D05B 35/06

[52] U.S. Cl. ..... 112/470.33; 112/318

[58] Field of Search ..... 112/470.33, 470.31, 112/314, 318, 322, 320, 470.02, 470.07

[56] References Cited

U.S. PATENT DOCUMENTS

| | | | |
|---|---|---|---|
| 4,073,248 | 2/1978 | Marforio | 112/322 X |
| 5,269,257 | 12/1993 | Yamazaki | 112/470.02 |
| 5,331,910 | 7/1994 | Mukai et al. | 112/322 X |
| 5,448,959 | 9/1995 | Nanthavong | 112/475.01 |
| 5,709,162 | 1/1998 | Pagett et al. | 112/470.07 |

*Primary Examiner*—Peter Nerbun
*Attorney, Agent, or Firm*—Brinks Hofer Gilson & Lione

[57] ABSTRACT

A mechanical metering attachment for sewing ribbon such as elastic or woven lace and woven elastic to men's and ladies' undergarments. The attachment can be used on a variety of commercially available industrial sewing machines and is driven by an available and appropriately located oscillating shaft that receives its drive from the main rotary shaft of the sewing machine. The attachment is driven through a one-way clutch that receives its input from the oscillating drive shaft. The feed rate of the ribbon or elastic woven lace can be adjusted by adjusting the point of connection of a connecting rod to a slotted lever which is part of the drive. The attachment includes a driven roll and a pressure roll. The pressure roll is biased into engagement with the pressure roll, and the pressure on the pressure roll can be adjusted to accommodate for the thickness of the ribbon being metered.

14 Claims, 4 Drawing Sheets

SEWING MACHINE HAVING A MECHANICAL METERING DEVICE

BACKGROUND OF THE INVENTION

This invention relates generally to a mechanical metering device for use with a sewing machine that feeds elastic or woven lace and woven elastic to the stitching mechanism of the sewing machine. This invention has been developed specifically for attaching elastic, woven lace and woven elastic to men's and ladies' undergarments. In a conventional sewing machine, the material being sewn is advanced along the line of stitching by the feed dog that contacts the bottom surface of the material. When it is desired to attach a stretched elastic band, woven lace or woven elastic to the upper surface of the material being sewn, it is necessary to meter the stretched band such that it is fed to the stitch forming mechanism in its stretched condition. It is important that such a metering mechanism can be adjusted so that the tension in the stretched band can be varied for the particular task being performed and also to properly locate the stretched band relative to the cloth fabric to which it is being attached. Another variable, that such a metering mechanism must have the capacity to accommodate, is the thickness of the elastic band. A metering device such as this requires a rotary drive and must be located near the stitch forming mechanism of the sewing machine.

BRIEF SUMMARY OF THE INVENTION

It is an object of this invention to provide a mechanical metering attachment for sewing elastic or woven lace and woven elastic to men's and ladies' undergarments. The attachment can be used on a variety of commercially available industrial sewing machines such as the Union Special Corporation class CS100 and FS300 machines. In the preferred embodiment, the elastic or woven lace is attached to the fabric by a 605 EFa-1 seam. There is no conveniently available rotary drive shaft in the sewing heads of the CS100 and FS300 sewing machines that can be utilized to drive the metering attachment. However, the oscillating drive shaft for the thread spreader is available and is appropriately located in the sewing heads. Thus, in the preferred embodiment, the drive for the attachment is taken from existing oscillating drive shafts that are available and appropriately located in the sewing heads of the CS100 and FS300 machines. Thus, one of the unique features of this invention is that it does not require the provision of an additional drive shaft, which is not only an economic advantage but also contributes greatly to the compactness of this attachment. The available oscillating drive is converted to rotary motion through a one-way clutch that is built into the metering attachment. As a result, the attachment is mounted on and driven by an oscillating drive shaft that is available and appropriately located in the sewing heads of available industrial sewing machines. This avoids the necessity of making costly modifications to the machines that this invention is to be mounted upon and greatly enhances the economic value of this invention.

DETAILED DESCRIPTION OF THE INVENTION

Figure 1:
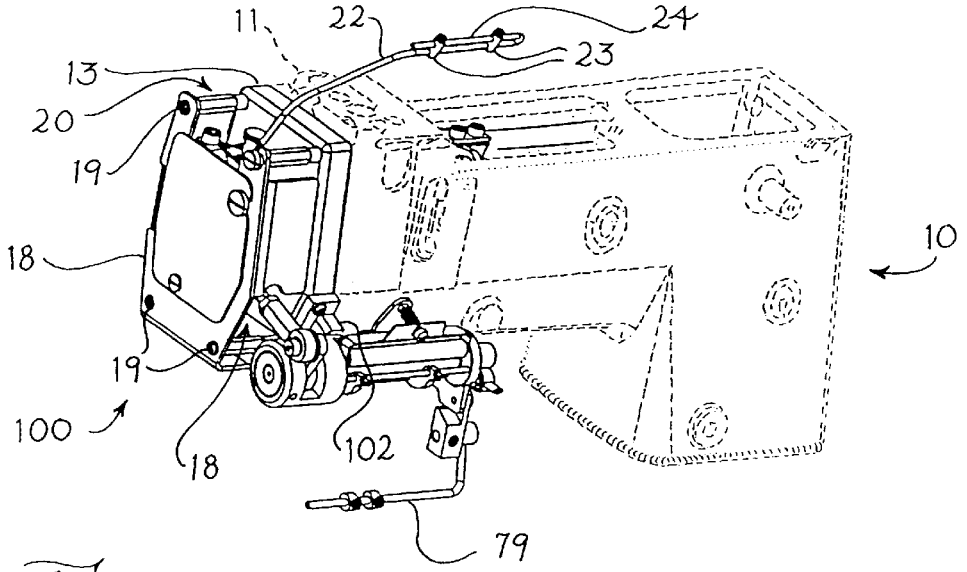
FIG. 1 is perspective view of the metering attachment mounted on a sewing machine that is shown in phantom lines.

In FIG. 1, the sewing machine 10 including the sewing head 11 are shown in phantom lines. The sewing head cover 13 and metering attachment 100 are shown in full lines. The machine 10 shown in FIG. 1 is a CS100 style industrial sewing machine that is manufactured and sold by Union Special Corporation, One Union Special Plaza, Huntley, Ill. 60142. However, it should be understood that this invention could be used in combination with other similar industrial sewing machines. Generally speaking, industrial sewing machines of this style include a reciprocating needle bar located in the sewing head, that carries one or more needles at its lower end. The machines also include other conventional stitch forming mechanisms such as a thread spreaders and loopers. These stitch forming mechanisms 31 enable machines of this type to be set up to produce a variety of standard stitches.

As seen in FIG. 1, a cover 18 is provided for the metering attachment drive link assembly 20. The cover 18 is mounted on the sewing head cover 13 by stand off screws 19. Also shown in this view is an elastic guide 22 that includes slide members 23 that can be adjusted to define a slot 24 of appropriate width for the elastic ribbon being applied. Slide members 23 can slide along guide 22 to adjust the width of slot 24.

Figure 2:
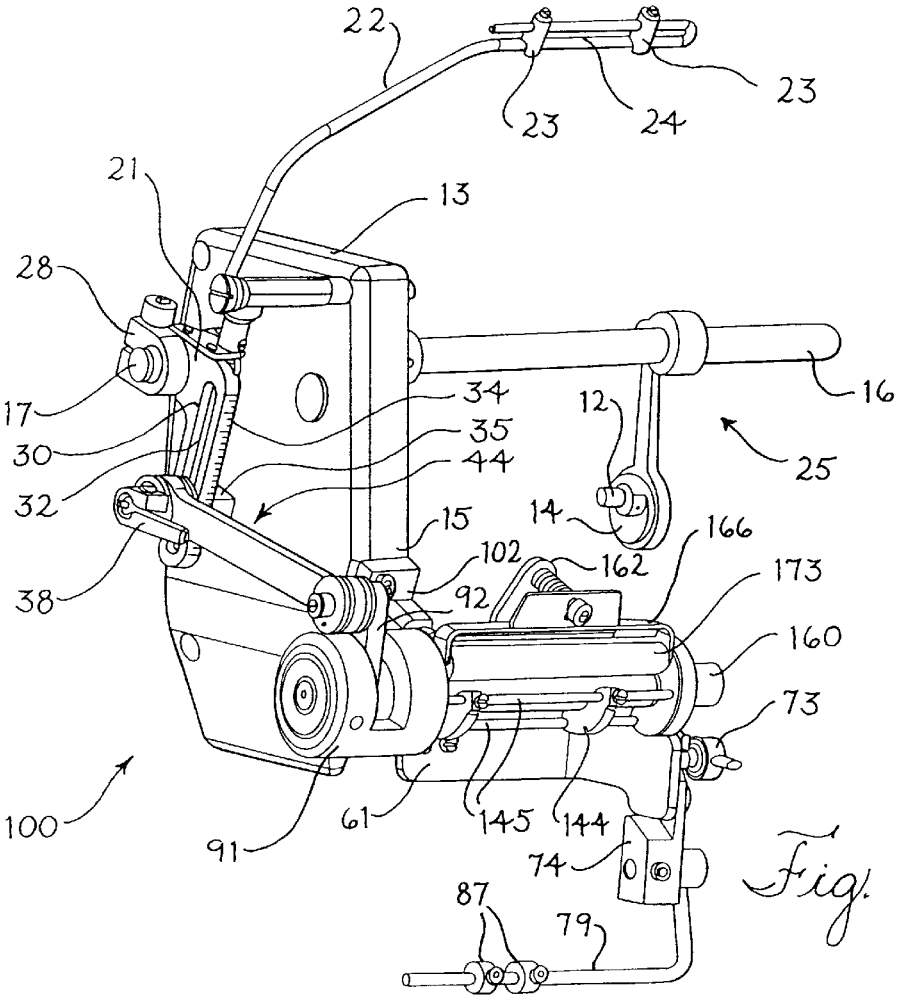
FIG. 2 is a perspective view of the mechanical metering attachment and the sewing head on which it is mounted.

Referring now to FIG. 2, the preferred embodiment of the metering attachment 100 is mounted on sewing machine IO through a mounting bracket 102. Sewing machine 10 has a main rotary drive shaft 12 from which all of the sewing machine components are driven, directly or indirectly. The sewing machine 10 also has oscillating shafts such as oscillating drive shaft 16. The primary purpose for oscillating drive shaft 16 is to drive the spreader which requires an oscillating drive. As illustrated in FIG. 2, the oscillating drive shaft 16 receives its drive from the main rotary drive shaft 12. Such a drive typically includes an eccentric 14 carried by the main rotary drive shaft 12 that is connected by a link and lever mechanism 25 to the oscillating driver shaft 16.

The driver shaft 16, that is a part of the drive link assembly 20, is mounted to freely oscillate in the sewing head cover 13. A drive lever 21 is carried by the free end 17 of driver shaft 16 externally of the sewing head cover 13. A shaft clamp 28 is provided to lock the drive lever 21 in position on the free end 17 of driver shaft 16. The drive lever 21 has the shape of an inverted L with a vertical slot 32 formed in its generally vertically extending leg 30. A slide bar and bearing 35 are secured in adjusted position in the vertical slot 32 by a lock mechanism 38. Indicia 34 is provided on the vertically extending leg 30 adjacent the vertical slot 32 to provide an indication of the corresponding stitch length for positions along the slot 32. A connecting rod 44, having bearings surfaces at both ends, connects the drive lever 21 to the roller clutch lever 92.

The roller assembly 101 will be discussed with reference to FIGS. 3–5. The roller assembly 101 includes a housing 146 that can be best seen in FIG. 3. The housing 146 is secured by screws 103 that extend through a mounting bracket bracket 102 to the forward edge 15 of the sewing head cover 13.

The housing 146 also serves as the housing for a roller clutch unit 90. The roller clutch unit 90 includes a clutch lever 92 that comprises an arm portion 93 and a hub portion 94.

Figure 6:
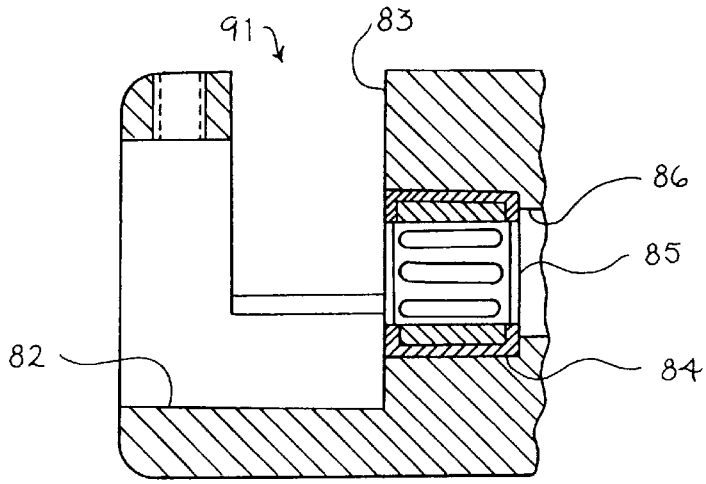
FIG. 6 is a cross-section view of the clutch housing.

A cross section view of the portion of housing 146 that functions as the clutch housing, hereinafter referred to as the clutch housing 91, is shown in FIG. 6. The clutch housing 91 has a generally cylindrical shape and has three central bores of different diameters formed therein. The largest bore 82 is formed from the left, as seen in FIG. 6, and provides a cavity for receiving the clutch lever 92. A slot 83 is formed in the cylindrical shaped portion of clutch housing 91 that is normal to its axis, which provides an opening through which the arm portion 93 of the roller clutch lever 92 extends. The slot is sized such that the arm portion 93 has sufficient space to oscillate. The second largest bore 84 is formed in the cylindrical-shaped potion of clutch housing 91 from the left, beginning at the end of the largest bore 82. A roller bearing 85 for the roller drive shaft 130 is received and retained in the second largest bore 84. The smallest bore 86 begins where the second largest bore 84 stops and extends out through the right side of the clutch housing 91. Bore 86 is dimensioned to receive a washer 95.

Figure 3:
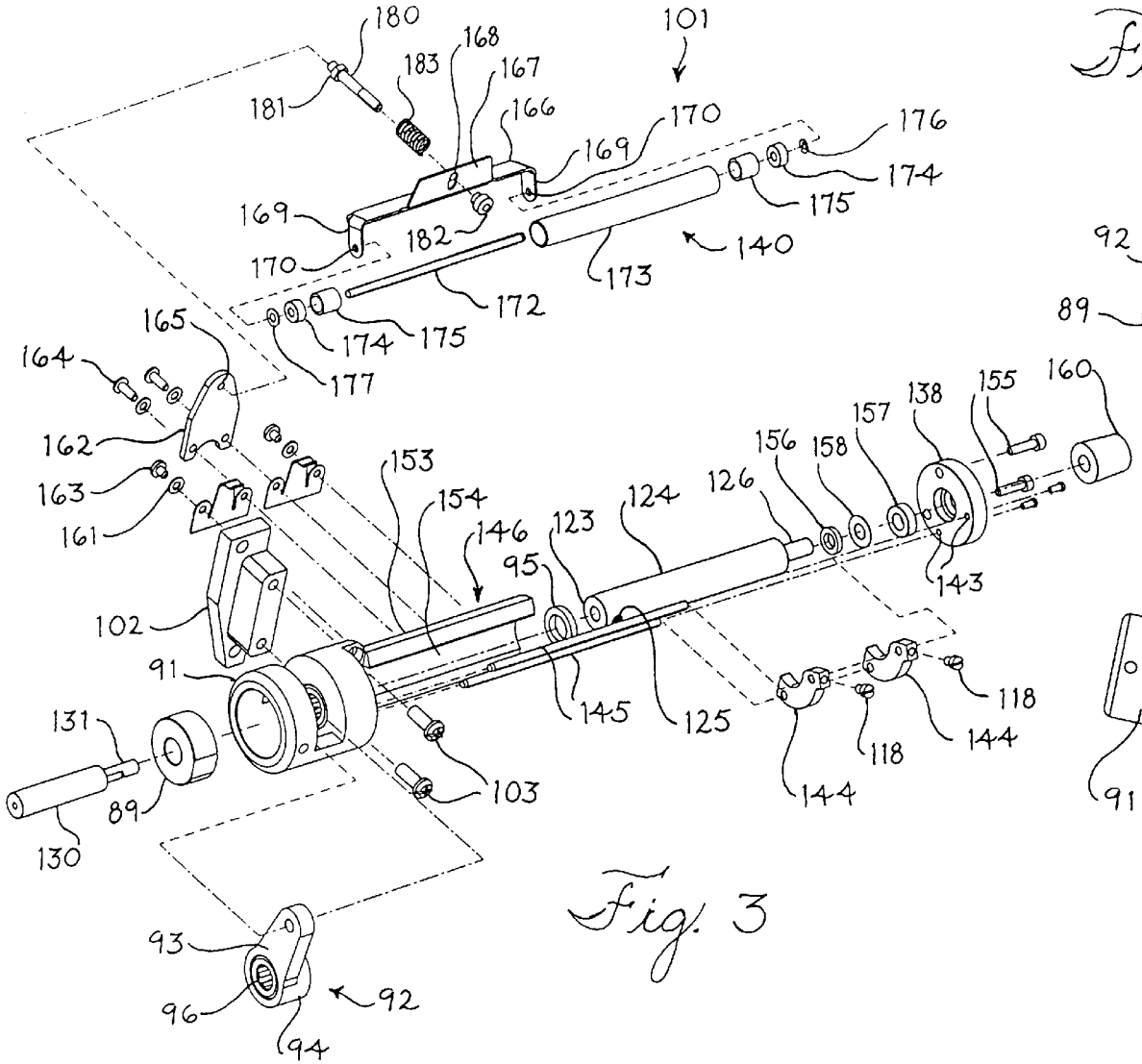
FIG. 3 is an exploded view of the roller assembly.

The roller clutch lever 92, see FIG. 3, includes a hub portion 94 and an arm portion 93. A one-way roller clutch 96, which is carried by the hub portion 94, is sized to receive and impart rotation in one direction to the roller drive shaft 130. The one-way clutch used in the preferred embodiment is purchased from The Torrington Company of Torrington, Connecticut. The roller drive shaft 130, seen in FIG. 3, is carried by a collar 89 that is dimensioned to be carried in the largest bore 82.

The housing 146 includes an elongated section 153 that extends to the right, as seen in FIG. 3, which includes a partial cylindrical internal surface 154. The roller drive shaft 130 has a smaller diameter portion 131 extending from the right end, as seen in FIG. 3, that slides into a bore 123 formed in the end of driven roller 124. The driven roller 124 is secured to the roller drive shaft 130 by set screws 125. The driven roller 124 includes an axially aligned shaft 126 that extends from its right hand end, as seen in FIG. 3. The roller end cover 138 is secured to the free end of the elongated section 153 of the housing 146 by screws 155.

A pair of tape guides 144 are slideably received on a pair of bars 145. Tape guides 144 can be fixed to bars 145 at selected positions by set screws 118. The position of the tape guides 144 on the bar 145 can be adjusted by loosening the set screws 118, sliding the tape guides to the desired position and tightening the set screws 118. The free ends of bar 145 are supported in apertures formed in the housing 146 and in aligned apertures 143 formed in the roller end cover 138.

The shaft 126 extending from the driven roller 124 extends through a spring washer 156, a washer 158 and a bearing 157 that are seated in the roller end cover 138. The roller end cover 138 is secured to the elongated section 153 by screws 155. A knob 160 is secured to the free end of shaft 126. The knob 160 allows the operator to manually rotate the driven roller 124.

As is best seen in FIG. 3, a pair of leaf springs 161 and a tension plate 162 are secured to the housing 146 by screws 163 and 164. Tension plate 162 has an aperture 165 formed therein.

A fork lever 166, formed from sheet metal, having an upstanding tab 167, a pair of downwardly extending end tabs 169 and a rearwardly extending section is pivotally mounted on the housing 146. The upstanding tab 167 has an aperture 168 formed therein and the end tabs 169 have apertures 170 formed therein.

A roller assembly 140 is carried by the fork lever 166 between the end tabs 169. The roller assembly 140 includes a hollow tube shaped roller 173 and a shaft 172 that extends centrally through roller 173. Bushings 175 are provided within each end of the hollow tube shaped roller 173 and bearings 174 are provided within each bushing 175. There is a washer 177 between bearing 174 and end tab 169, carried by the left end of shaft 172 as seen in FIG. 3. A retaining ring 176 is provided on the right end of shaft 172. The free ends of shaft 172 are received in the apertures 170 that are formed in the end tabs 169.

Figure 4:
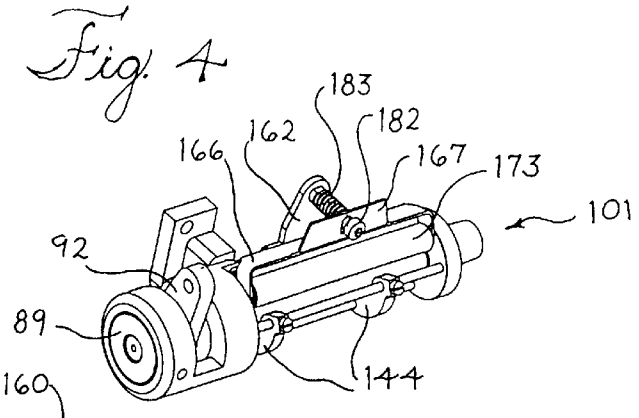
FIG. 4 is a perspective view of the roller assembly.
Figure 5:
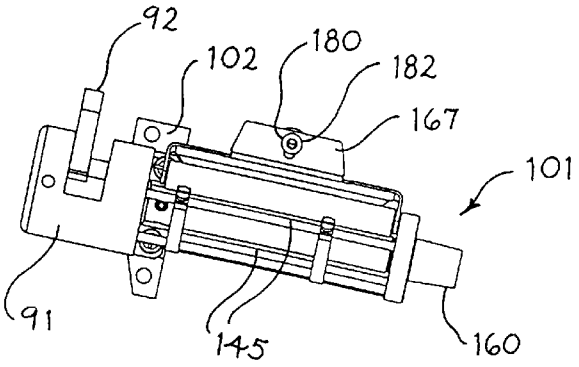
FIG. 5 is a front view of the roller assembly.

As is best seen in FIGS. 3–5, a tension post 180 extends through the aperture 165 formed in the tension plate 162 and the aperture 168 formed in the upstanding tab 167. The tension post 180 includes an enlarged portion 181 near one end that rests against the tension plate 162 and functions to prevent the tension post 180 from passing through aperture 165. The other end of the tension post 180 is threaded and receives a knob 182. A coil spring 183 surrounds tension post 180 between tension plate 162 and the upstanding tab 167. As the knob 182 is threaded on to the threaded end of tension post 180, the coil spring 183 is compressed, and when the knob 182 is unthreaded, the coil spring 183 expands.

Figure 7:
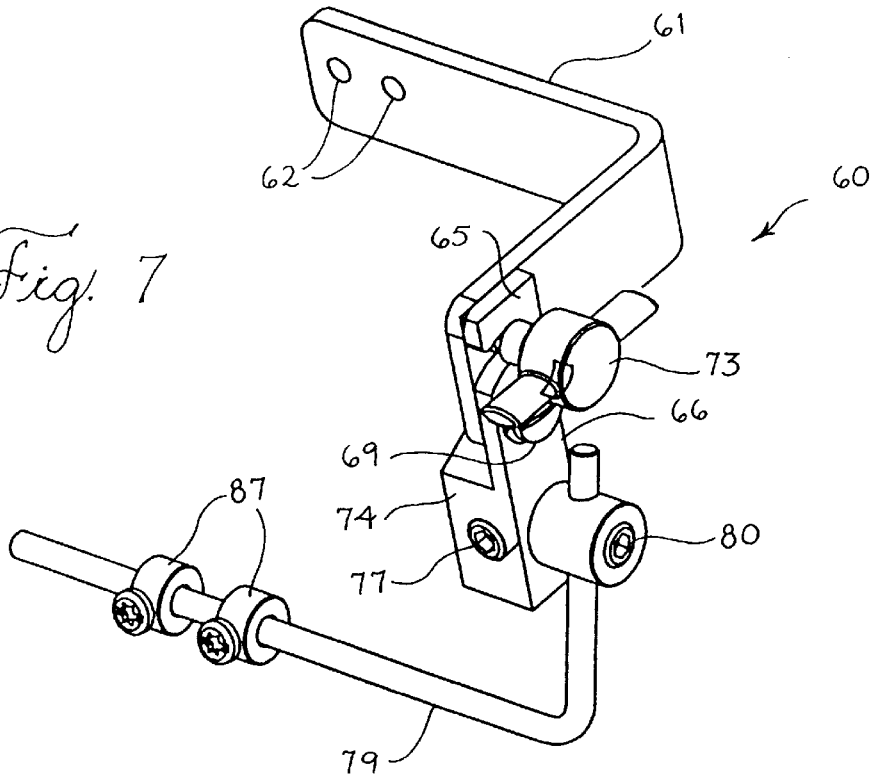
FIG. 7 is an isolated perspective view of the tape guide assembly.
Figure 8:
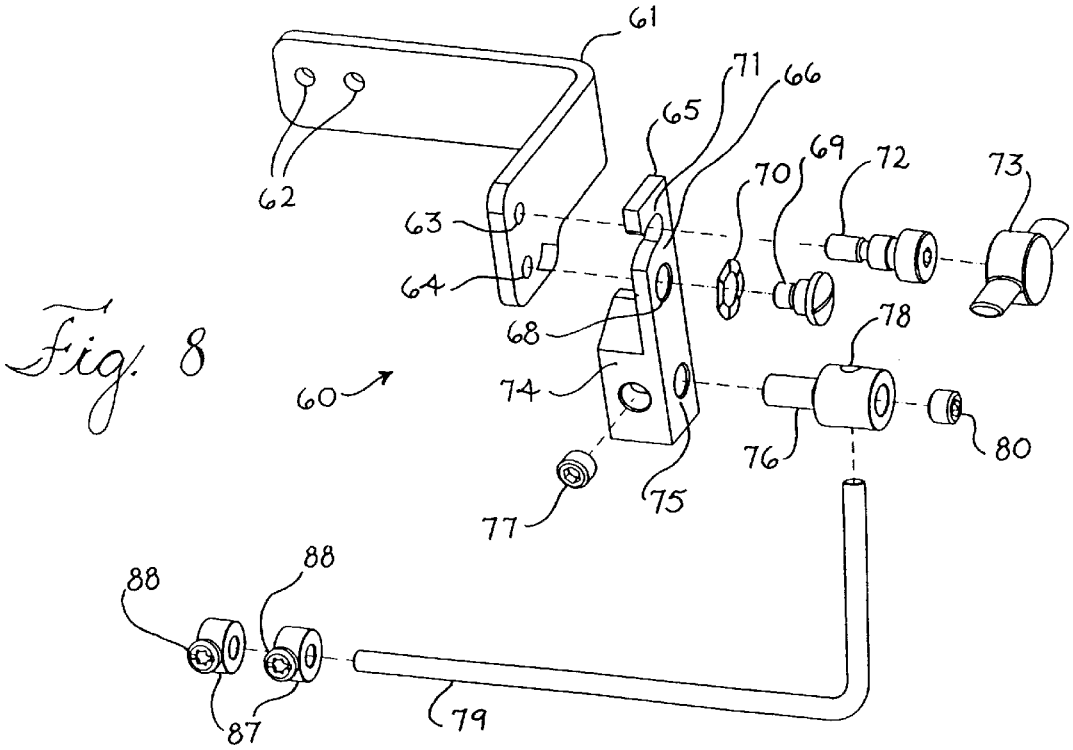
FIG. 8 is an exploded view of the tape guide assembly.

The structure of the tape guide assembly 60 will be discussed with reference to FIGS. 7 and 8. The tape guide assembly 60 receives the tape from the roller assembly 101 and guides it into the stitch forming mechanisms 31. The tape guide assembly is, however, mounted independent of the roller assembly 101 and is secured to the sewing head 11 through an L-shaped bracket 61. The L-shaped bracket 61 has apertures 62 formed in one end thereof by which it is secured to the sewing head 11. The L-shaped bracket 60 has vertically spaced threaded apertures 63 and 64 formed in its other end. A tape guide holder 65 is secured to the L-shaped bracket 61 through threaded apertures 63 and 64. The holder 65 includes an upright flat arm 66 that engages the bracket 61 in surface to surface contact in the surface adjacent threaded apertures 63 and 64. An aperture 68 is formed in the flat arm 66 that is aligned with aperture 64 formed in bracket 61. The holder 65 is pivotally attached to the bracket 61 by a screw 69, carrying a washer 70, that extends through aperture 68 and is threaded into threaded aperture 64. The flat arm 66 has an arcuate slot 71 that is formed in the flat arm 66 about the center of aperture 68. The arcuate slot 71 has a radius that is equal to the distance between the apertures 63 and 64 such that when the holder 65 pivots about screw 69, the arcuate slot 71 is always aligned with threaded aperture 63 formed in bracket 61. A shoulder screw 72 extends through arcuate slot 71 and is threaded into threaded aperture 63, thus providing a locking mechanism for securing the holder 65 in a predetermined position relative to the bracket 61. The shoulder of shoulder screw 72 is larger than the arcuate slot 71 and, thus, engages the outer surface of flat arm 66 as the shoulder screw 72 is threaded into threaded aperture 63. A tee knob 73 is secured to the shoulder screw 72 to facilitate hand adjustment of this locking mechanism. The holder 65 includes a block portion 74 from which the flat arm portion 66 extends. A bore 75 is formed in the block portion 74 into which a stud 76 extends. The stud 76 can rotate in the bore 75 and can be secured in a selected position by a set screw 77. The stud 76 has an enlarged portion in which a bore 78 is formed. Bore 78 is normal to the longitudinal axis of stud 76. One arm of an L-shaped tape guide rod 79 extends through bore 78 and can be secured in a selected location by a set screw 80. A pair of collars 87 are carried by the other arm of L-shaped tape guide rod 79. Each collar 87 has a set screw 88 that permits the collars to be located on the L-shaped tape guide rod to accommodate the elastic tape being applied. The collars 87 are secured to guide rod 79 at the location that corresponds to where the tape is to be applied to the work product.

Figure 9:
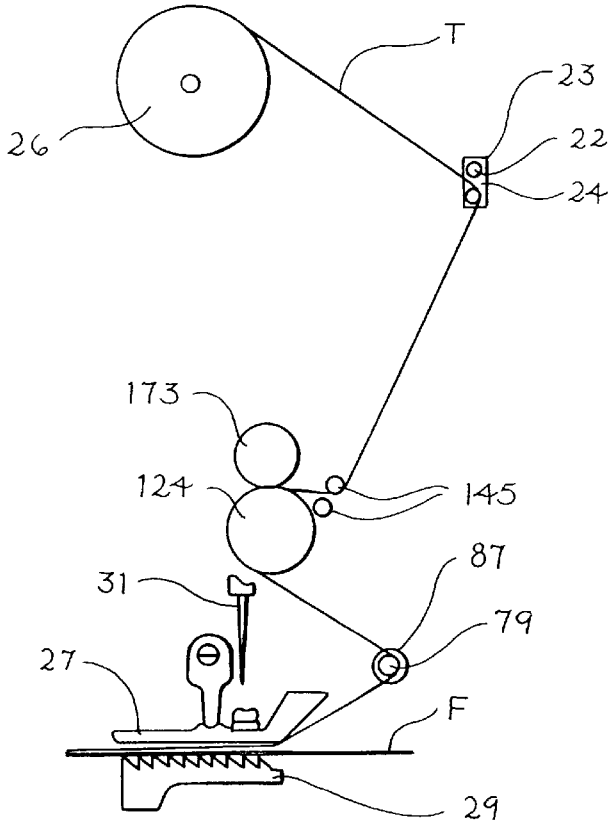
FIG. 9 is a schematic view of the path of the tape from the supply roll to the stitch forming mechanisms.

The operation of the metering attachment 100 mounted on the sewing machine 10 will be discussed with reference to FIG. 9. A supply of elastic tape T is provided on a supply roll 26. The tape T is threaded through a slot 24 formed by slide members 23 on the elastic guide 22. The tape 1 is then directed to the roller assembly 101 of the metering attachment 100 where it extends between bars 145 between the pair of tape guides 144. The tape T is then directed between the driven roller 124 and the roller 173 and wraps around driven roller 124. The tape T is then directed to the tape guide assembly 60 where it wraps around the tape guide rod 79 between the collars 87. The tape T is then in a position to be fed below the presser foot 27 and stitch forming mechanisms 31 on the upper surface of the fabric F. The feed dog 29 that engages the bottom surface of the fabric F advances the fabric F at a predetermined rate. The metering attachment 100 advances the tape T at a slower rate than the fabric's predetermined rate. As a result of the tape T being metered at a slower rate than the feed rate of the fabric F, the elastic tape T is stretched to compensate for the different feed rates. Thus, the section of tape T from the point of engagement of rolls 124 and 173 to the point where it is stitched to the fabric F will be in a stretched condition. The metering rate of the metering attachment 100 is determined by the link assembly 20 for the metering attachment 100. The amount of stretch that is applied to the tape T can be adjusted by changing the point of connection of connecting rod 44 along the slot 32 formed in the vertically extending leg 30 of the link assembly 20.

The foregoing specification describes only preferred embodiments of the invention as shown. Other embodiments besides the ones described above may be articulated as well. The terms and expressions, therefore, serve only to describe the invention by example only and not to limit the invention. It is expected that others perceive differences which, while differing from the foregoing, do not depart from the spirit and scope of the invention herein described and claimed.

I claim:

1. A sewing machine including a main drive shaft and stitch forming mechanism that are driven by said main drive shaft;

an attachment mounted on said sewing machine for metering an elastic ribbon to said stitch forming mechanism to be sewn to a garment in a stretched condition;

said attachment including a drive mechanism, said drive mechanism including a one way clutch and an adjustable drive extending between said main drive shaft and said one way clutch;

said attachment further including a driven roll that is driven by said one way clutch and a pressure roll that is biased into engagement with said driven roll; and adjustment mechanism for adjusting said pressure roll to accommodate ribbons of various thickness.

2. The invention as stated in claim 1 wherein:

said main drive shaft is a rotary shaft;

said adjustable drive extending between said main drive shaft and said one way clutch including an attachment drive shaft and an eccentric for converting rotary motion from said main drive shaft to oscillating motion which is imparted to of said attachment drive shaft.

3. The invention as stated in claim 2 wherein:

said adjustable drive extending between said main drive shaft and said one way clutch further includes a drive lever secured to said attachment drive shaft;

said drive lever including a leg having a slot formed therein;

said one way clutch including a clutch lever having an arm; and a connecting rod connected at one end to said clutch lever arm and at its other end to a selected position along said slot formed in said drive lever leg.

4. The invention as set forth in claim 1 wherein:

said attachment includes a housing on which is mounted a tension plate;

a fork lever;

said pressure roll being mounted on said fork lever for free rotation;

said fork lever being pivotally connected to said housing; and an adjustable spring mechanism causing said fork lever to pivot about its pivot connection such that said pressure roll is biased into engagement with said driven roll.

5. The invention as set forth in claim 4 wherein:

said invention further includes a spring device for maintaining said fork lever engaged in said pivot connection with said housing.

6. The invention as set forth in claim 2 wherein:

said attachment includes a housing on which is mounted a tension plate;

a fork lever;

said pressure roll being mounted on said fork lever for free rotation;

said fork lever being pivotally connected to said housing; and an adjustable spring mechanism causing said fork lever to pivot about its pivot connection such that said pressure roll is biased into engagement with said driven roll.

7. The invention as set forth in claim 6 wherein:

said invention further includes a spring device for maintaining said fork lever engaged in said pivot connection with said housing.

8. A sewing machine including stitch forming mechanism, a main rotary drive shaft and an oscillating drive shaft, said stitch forming mechanism and said oscillating drive shaft being driven by said main rotary drive shaft;

an attachment mounted on said sewing machine for metering an elastic ribbon to said stitch forming mechanism to be sewn to a garment in a stretched condition;

said attachment including a housing and an adjustable drive mechanism that is operatively connected to said oscillating drive shaft;

said attachment further including a driven roll and a pressure roll that are mounted for rotation on said housing, said pressure roll being biased into engagement with said driven roll; and said drive mechanism including a one-way clutch for converting the oscillating motion from said oscillating drive shaft to rotary motion for driving said driven roll.

9. The invention as set forth in claim 8 wherein:

said adjustable drive mechanism permits said attachment to feed elastic material at a predetermined ratio relative to the feed rate of the material being sewn such that the elastic web is sewn to the material in a stretched condition.

10. The invention as stated in claim 8 wherein:

said adjustable drive extending between said main drive shaft and said one way clutch further includes a drive lever secured to said oscillating drive shaft;

said drive lever including a leg having a slot formed therein;

said one way clutch including a clutch lever having an arm; and a connecting rod connected at one end to said clutch lever arm and at its other end to a selected position along said slot formed in said drive lever leg.

11. The invention as set forth in claim 8 wherein:

said attachment includes a housing on which is mounted a tension plate;

a fork lever:

said pressure roll being mounted on said fork lever for free rotation;

said fork lever being pivotally connected to said housing; and an adjustable spring mechanism causing said fork lever to pivot about its pivot connection such that said pressure roll is biased into engagement with said driven roll.

12. The invention as set forth in claim 11 wherein:

said invention further includes a spring device for maintaining said fork lever engaged in said pivot connection with said housing.

13. The invention as set forth in claim 9 wherein:

a tension plate is mounted on said housing;

a fork lever;

said pressure roll being mounted on said fork lever for free rotation;

said fork lever being pivotally connected to said housing; and an adjustable spring mechanism causing said fork lever to pivot about its pivot connection such that said pressure roll is biased into engagement with said driven roll.

14. The invention as set forth in claim 13 wherein:

said invention further includes a spring device for maintaining said fork lever engaged in said pivot connection with said housing.

* * * * *